United States Patent [19]

Britt

[11] Patent Number: 4,560,972

[45] Date of Patent: Dec. 24, 1985

[54] HOUSING FOR EVAPORATIVE COOLER CONTROL DEVICE

[76] Inventor: Paul E. Britt, 5420 LaEstancia, El Paso, Tex. 79932

[21] Appl. No.: 457,357

[22] Filed: Jan. 12, 1983

[51] Int. Cl.[4] ..... H01H 37/52

[52] U.S. Cl. ..... 337/338; 200/294; 337/380; 361/331

[58] Field of Search ..... 337/380, 381, 299, 301, 337/1, 2, 3, 42, 338; 174/48; 361/331; 236/94; 165/27; 200/294; 307/140

[56] References Cited

U.S. PATENT DOCUMENTS

| | | | |
|---|---|---|---|
| 1,730,600 | 10/1929 | Both . | |
| 2,611,500 | 9/1952 | Martin . | |
| 2,878,344 | 3/1959 | Gustafson et al. | 337/338 |
| 2,888,537 | 5/1959 | Mears | 200/294 |
| 3,223,807 | 12/1965 | Grahl | 337/338 |
| 3,242,293 | 3/1966 | Manecke | 337/338 |
| 3,421,131 | 1/1969 | Moyer et al. | 337/338 |
| 3,524,952 | 8/1970 | Anderson et al. . | |
| 3,712,967 | 1/1973 | Carson . | |
| 4,013,219 | 3/1977 | Jacobson | 337/301 |
| 4,150,718 | 4/1979 | Kolbow | 337/301 |

*Primary Examiner*—Harold Broome

*Attorney, Agent, or Firm*—Fleit, Jacobson, Cohn & Price

[57] ABSTRACT

A switch housing for a control device which includes both automatically thermally operable and manually operable switches. The housing is adapted to be positioned on a wall or other surface and can be secured to a single or double electrical junction wall box. The housing includes an integral mounting bracket to support one or more switches outwardly of a base panel, and a supporting bracket to support a bimetallic element. A cover is provided to enclose the housing and includes apertures through which the several switches and controls can extend.

12 Claims, 5 Drawing Figures

HOUSING FOR EVAPORATIVE COOLER CONTROL DEVICE

BACKGROUND OF THE INVENTION

1. Field of the Invention

This invention relates to a housing for switches, and more particularly to a housing for multiple control switches for a controlled system wherein all switch functions are contained within a unitary structure which can be wall mounted.

2. Description of the Prior Art

The use of evaporative cooling in residential cooling systems is prevelant in many parts of the country as a substitute for the structurally more complex and more expensive mechanical-refrigeration type air conditioning units. Such evaporative cooling systems include a pump for conveying water from a reservoir into a pad of air permeable material and a blower fan for drawing outside air through the wetted pad and for forcing the air into the spaces desired to be cooled. The air passing through the pad causes evaporation of the water, thereby cooling the air by the transfer of sensible heat from the air into latent heat to change the phase of the water from liquid to a vapor.

Control devices often used with such systems include a low voltage, thermostatically operative switch positioned in the area to be cooled, or separate manual pump operation and blower operation switches, without a thermostatic switch, or a line voltage thermostat coupled to manual pump and blower control switches. The thermostatically operated switch is an on-off device that serves to automatically control the overall operation of the system. The manually operated switches oan be provided so that the user can turn on the blower and set the blower speed at either a high or a low speed setting, and so that the user can control the operation of the pump in an on or an off mode, the pump on mode permitting evaporative cooling to occur while the pump off mode permits circulation of uncooled air by means of the blower. In any event, the prior control devices were so arranged that the thermostatic switch, when provided, was physically distant from the manual switches, which resulted in a cumbersome arrangement.

SUMMARY OF THE INVENTION

It is an object of the present invention to provide a housing for control switches utilized in an environmental control system whereby all the operating switches for the system are contained in a unitary housing.

It is another object of the present invention to provide an improved housing for a plurality of switches whereby the housing can be secured to a standard electrical junction box.

It is still a further object of the present invention to provide a unitary switch housing structure which can be mounted on a suitable surface and which presents the several switching devices in a compact, universally attachable housing which is simple to install.

Briefly stated, in accordance with one aspect of the present invention, a switch housing is provided for a control device which includes manually and automatically operable switch means. The housing includes a base having means for mounting the base on a surface. The base also includes a main panel and at least one mounting panel which extends outwardly from the main panel. The mounting panel including means to position one or more manually operable switches thereon. The base also includes means to removably receive and retain a cover member, and also includes means for mounting a switch means directly thereto and an integral wiring duct to permit the passage therethrough of electrical wires connected to the switch means. A cover member is provided and includes a face panel and means extending outwardly from the face panel for engaging the retention means on the base. The face panel includes appertures to permit the switches to project therethrough in order to permit manual adjustment thereof. Additionally, the face panel also includes means for permitting air to circulate within the housing and around the thermally operated switch.

DESCRIPTION OF THE PREFERRED EMBODIMENTS

Figure 1:
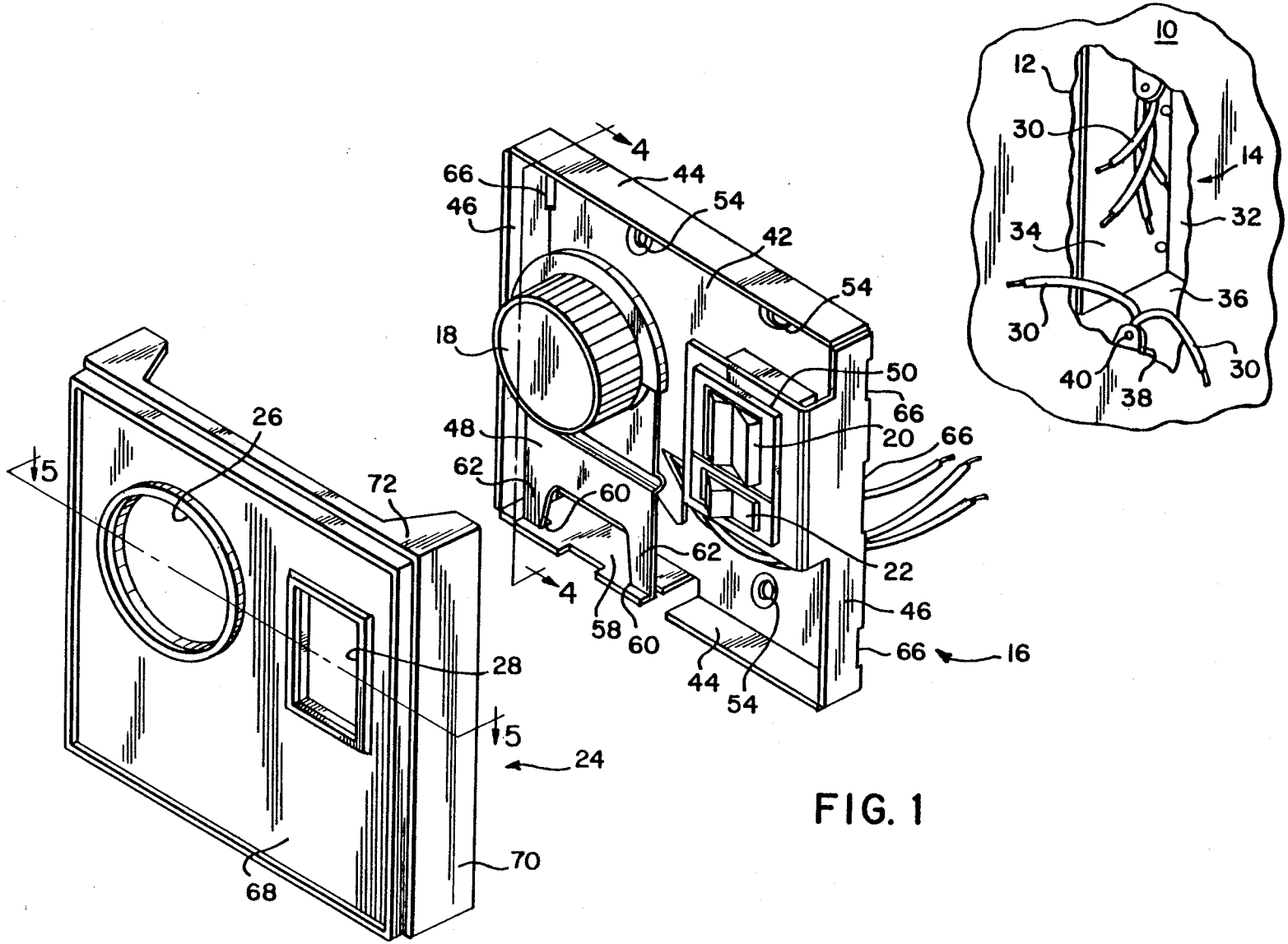
FIG. 1 is an exploded perspective view showing the several parts of the housing of the present invention in relation to a wall panel surface and a wiring box to which the housing can be attached.

Referring now to the drawings, and particularly to FIG. 1, there is shown a portion of a wall 10 having a generally rectangular opening 12 in which an electrical junction box 14 is recessed. A switch housing 16 is provided and includes the various switches 18, 20, and 22 for the system which is controlled thereby. Housing 16 is adapted for attachment to junction box 14. A cover 24 is provided for removable engagement with housing 16 to enclose the switches. Cover 24 includes apertures 26 and 28 to permit the manually operable portions of the respective switches to extend therethrough. Cover 24 can be of any convenient configuration, and can be suitably decorated and configured so as to present a pleasing appearance and also to be compatible with the functions which the housing performs.

Junction box 14 is of generally rectangular cross section and extending there into are respective ends of a plurality of conductors 30 in the form of electrical wires which are connectable with the several switching elements contained within the housing of the present invention. Junction box 14 includes a inner panel 32 spaced inwardly of the surface of wall 10 and two pairs of opposed side panels 34, 36, only one of each of the latter of which is visible in FIG. 1. A pair of inwardly directed, opposed tabs 38 extend from the outer edges of side panels 36 and lie in a common plane adjacent the plane of the outer surface of wall 10. Each of tabs 38 includes a threaded aperture 40 to permit switch housing 16, or the like, to be removably secured thereto. Although shown as a standard single box, a standard double box opening which has the same height as the single box but which is twice as wide, can also be used, if desired. Thus, the present invention is adaptable for either of the commonly used junction box sizes, and thereby provides greater versatility in use.

Switch housing 16 includes a generally planar rectangular base panel 42 and two pairs of opposed, generally parallel side panels 44, 46 which extend outwardly from the peripheral edges of base panel 42. A thermally operated switch is secured to the back face of base panel 42 and will be described hereinafter. A rotatable control knob is carried by base panel 42 and engages a bimetallic element 48 responsive to ambient temperature. Additionally, a pair of rocker-type function switches 20, 22 are carried by housing 16 on an outwardly extending bracket 50, which is integral with one of side panels 46. Switch 20, which controls the blower, can be a three position rocker switch for off, low blower speed, and high blower speed functions, respectively. Switch 22 which controls the water pump (not shown), can be a two position rocker switch, as shown, for both on and off positions. A conductor duct 52 is provided to permit the respective wires connected to the several switches to pass from the wall and into housing 16 through base panel 42, the duct being positioned beneath bimetallic element 48 in such a way as not to interfere with its operation.

Figure 2:
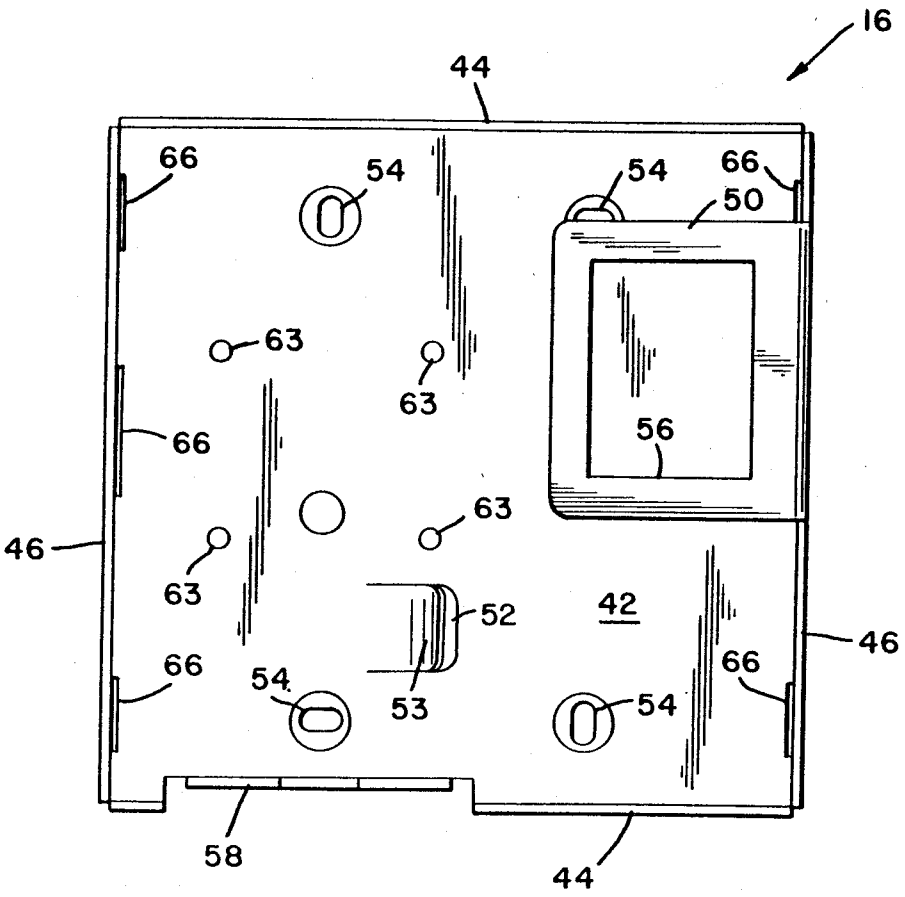
FIG. 2 is a front elevational view of the base of the housing.

Switch housing 16 without the several switches in position is shown in elevation in FIG. 2. As shown, base panel 42 is of generally square configuration and includes four openings 54, the openings being provided in a rectangular array to permit the attachment of base panel 42 to a conventional electrical junction box 14 as illustrated in FIG. 1. Either of two of openings 54 can be utilized to secure base panel 42 to a single junction box by means of suitable bolts to engage threaded apertures 40. If a double junction box is provided in the wall, all four of the openings can be utilized to effect the attachment of the base panel thereto.

Outwardly extending side panels 44, 46, together with base panel 42, define the periphery of the interior portion of housing 16. As shown, each of panels 44 and 46 are rectangular extensions of base panel 42. One of panels 46 includes an integrally formed planar mounting bracket 50, which preferably lies in a plane parallel to and spaced from base panel 42. A suitable opening 56 is provided in bracket 50 to permit the positioning therein of switches 20, 22 (see FIG. 1). In the embodiment shown, opening 56 is generally rectangular and is capable of receiving a pair of rectangular base, rocker-type switches 20, 22 positioned in side-by-side relationship, the switches preferably including suitable means to engage the edges of opening 56 to provide a secure mechanical interconnection therewith. As best seen in FIG. 2, one of side panels 44 includes an inwardly positioned supporting panel 58 which extends outwardly from base panel 42 and includes a pair of spaced slots 60 to receive a pair of legs 62 of bimetallic sensing element 48 and to retain the legs in a predetermined position.

Referring once again to FIG. 2, base panel 42 also includes a plurality of suitably positioned apertures 63 spaced inwardly of panels 44, 46 to permit the securement to panel 42 of a thermal switch which is operatively connected with bimetallic element 48.

Also provided in base panel 42 is conductor duct 52 to permit wire conductors 30 to pass therethrough for interconnection of the wiring extending through the wall structure with the several switches, the ends of which conductors extend into wall junction box 14 (see FIG. 1). As shown, duct 52 is defined by a generally rectangular opening provided by a three sided cut defining a tab 53 in base panel 42, which tab can be bent outwardly or inwardly to provide a conductor duct. Preferably duct 52 is so positioned that it does not interfere with the positioning of rocker switches 20, 22, or with the positioning or functioning of bimetallic element 48.

Figure 3:
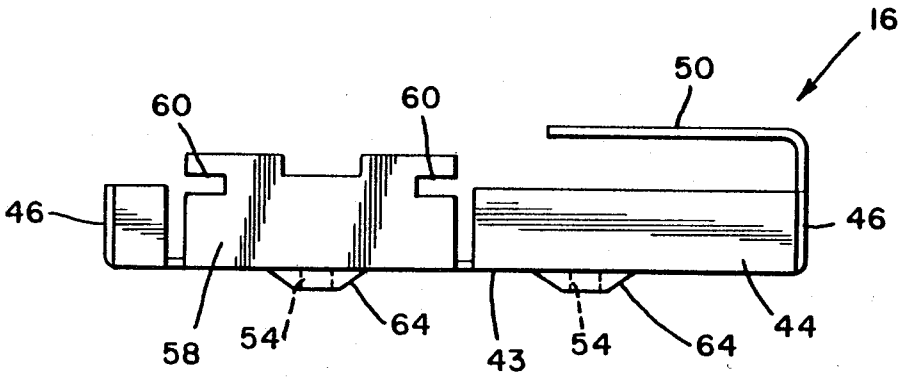
FIG. 3 is a bottom view of the base of the housing.

As shown most clearly in FIG. 3, openings 54 are each surrounding by a rearwardly directed boss 64, which serves to space rear face 43 of base panel 42 from the outwardly facing surfaces of tabs 38 and from the outer surface of wall 10.

Referring once again to FIGS. 1 and 2, the junctions between base panel 42 and side panels 46 include a plurality of linear slots 66 positioned along the periphery of base panels 42 to facilitate the attachment of cover 24, as will hereinafter be more fully described. Switch housing 16 can be made from sheet metal, suitably die cut, scored, and bent to provide the structure illustrated. If desired, however, the housing can also be made from molded plastics.

Figure 4:
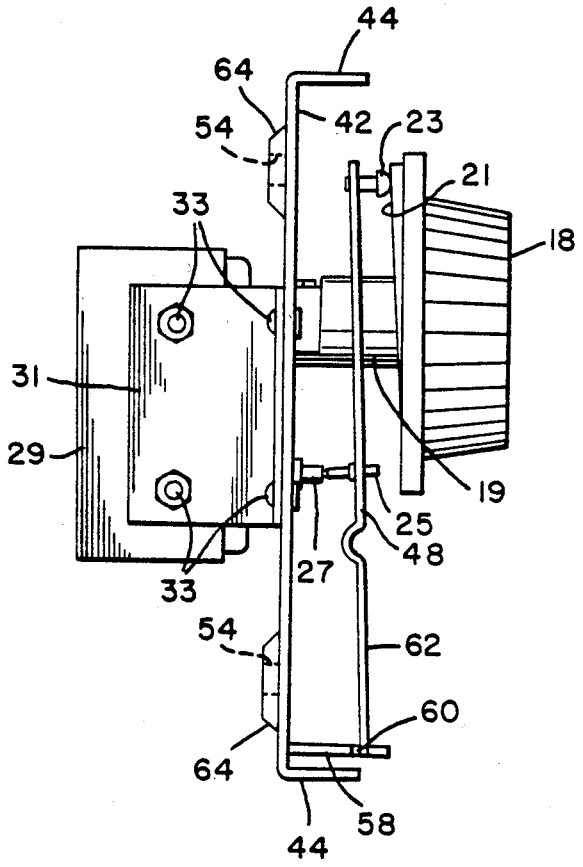
FIG. 4 is a cross-sectional view taken along line 4—4 of FIG. 1.

As shown in FIG. 4, control knob 18 extends outwardly from base panel 42 and is rotatable about shaft 19. A cam 21 is provided on knob 18 and bears against a rubbing block 23 carried by bimetallic element 48 to move the upper edge thereof toward and away from base panel 42. Element 48 is restrained at the lower extremities of legs 62 by notches 60. Positioned intermediate the ends of bimetallic element 48 is a threaded rod 25 which can be moved toward or away from base panel 42 for calibration purposes and which engages an aligned actuator 27 extending from a microswitch 29, which is a switch capable of operating on line voltage, rather than on a reduced voltage. A pair of angle brackets 31, only one of which is visible in FIG. 4, secure microswitch 29 in position by means of bolts 33. Microswitch 29 extends into box 14 when housing 16 is secured thereto.

Figure 5:
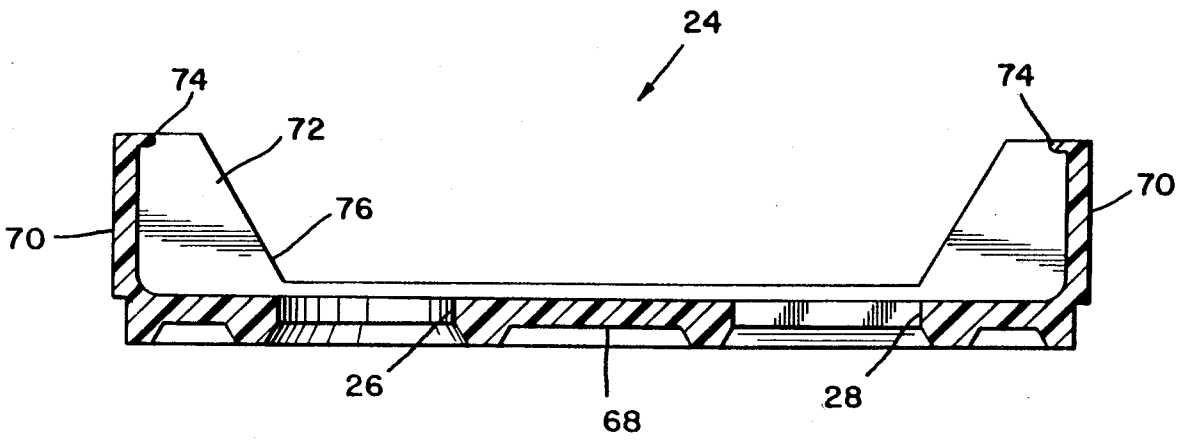
FIG. 5 is a transverse cross-sectional view through the cover of the housing and taken along the line 5—5 of FIG. 1.

Cover 24 is illustrated in perspective in FIG. 1 and in cross section in FIG. 5. As shown, cover 24 includes a front panel 68 which is adapted to be in overlying relationship with and spaced from base panel 42 of switch housing 16. Front panel 68 includes a pair of openings 26, 28 through which control knob 18 and the outwardly extending portions of the respective switches 20, 22, and 16 extend. Knob 18 is rotatable and therefore opening 26 is circular in configuration. Switches 20 and 22 are rectangular rocker-type switches, and consequently opening 28 is of generally rectangular configuration. Extending inwardly from the peripheral edges of front panel 68 are two pairs of opposed side panels 70, 72, only one of each of which is visible in FIG. 1.

As best seen in FIG. 5, end panels 70 are formed integrally with front panel 68 and include inwardly directed spaced flanges 74 at their respective innermost edges, the flanges being engageable with notches 66 in housing 16. Additionally, panels 72, above and below bimetallic element 48, each include a cutout area 76 which permits ambient air to circulate around bimetallic element 48 when cover 24 is in place over housing 16. Cover 24 can be metallic, or it can be made of plastic, and can be provided in any of a number of attractive configurations and designs to render the same visually appealing.

In operation, the respective switches 20, 22, and 29 are mounted to switch housing 16. Microswitch 29 is attached to the housing by means of bolts as hereinbefore described while rocker switches 20, 22 can be snapped into position in opening 56 of bracket 50. The respective conductors from the switches are routed through duct 52 formed in base panel 42 and are interconnected with the corresponding conductors 30 within junction box 14. After the electrical connections have been made, housing 16 is secured to junction box 14 by means of bolts which extend through apertures 54 provided in base panel 42 and engage corresponding threaded apertures 40 in junction box tabs 38. In the single junction box installation, housing 16 is so positioned that switch 29 extends into the box and duct 52 is in communication with the box to permit connection of the conductors. The attachment to a double junction box is the same as that for a single box except that two additional screws can be utilized, although it is not essential that they be used. In fact, in a double junction box arrangement, an upper and lower aperture of either of the apertures provided can be utilized to provide a substantially diagonal securing arrangement, if desired. Thus the housing of the present invention by positioning switches 20 and 22 outwardly of the junction box permits the housing to be used with a small, single box without interfering with the positioning of the housing, and is also of a size to permit the housing to be used with a larger box while completely covering it.

After switch housing 16 has been securely attached to junction box 14, cover 24 is placed over the housing and snapped into position by means of the interengagement of flanges 74 and notches 60. The user can then set the respective switches in accordance with the desired mode of operation of the device being controlled.

While particular embodiments of the present invention have been illustrated and described, it will be apparent to those skilled in the art that various changes and modifications can be made without departing from the spirit and scope of the invention, and it is intended to encompass within the appended claims all such changes and modifications that fall within the scope of the present invention.

What is claimed is:

1. A switch housing comprising: a base panel including a pair of opposed side panels that extend outwardly from said base panel, means for securing said base panel to a supporting surface, said base panel including first switch positioning means for positioning first switch means on a surface of said base panel second switch positioning means extending from one of said side panels carried by said base panel and spaced laterally from said first switch positioning means and outwardly from the surface of said base panel for positioning second switch means, said second switch positioning means including a substantially planar mounting bracket spaced outwardly from and substantially parallel to said base panel and integral with said one of said side panels, said second switch positioning means having an opening to receive and support said second switch means, and cover means removably attached to said base panel to define an enclosure therewith for housing said second switch means.

2. The housing of claim 1, wherein said base panel includes conductor duct means to permit the passage through said base panel of electric conductors connected to said second switch means, and wherein said duct means is integral with said base panel and is defined by a cut in said base panel that defines a tab which can be bent relative to said base panel to expose an opening in said base panel.

3. The housing of claim 1 including bimetallic element supporting means extending outwardly from and carried by said base panel for supporting a bimetallic element in spaced relationship to said base panel.

4. The housing of claim 1 wherein said switch housing includes first switch means carried on said base panel, said first switch means including a thermally responsive switch operatively associated with a bimetallic element supported by said bimetallic element supporting means and said switch housing includes second switch means carried by said second switch positioning means, said second switch means including at least one manually operable switch.

5. The housing of claim 1 wherein said base panel is substantially planar and includes means to space the surface thereof from the surface to which said base panel is mounted and a second pair of opposed side panels extending outwardly relative to said supporting surface to define an interior space within which a second switch can be positioned.

6. The housing of claim 1 wherein said housing includes retention means positioned adjacent the intersection of said side panels and said base panel, said cover means having a front panel and means extending outwardly from said front panel for engaging said retention means, said front panel including aperture means to permit first and second switches to extend partially therethrough to permit manual adjustment thereof.

7. The housing of claim 6 wherein said engaging means includes inwardly extending flanges spaced from said front panel and said retention means includes linear slots positioned along the periphery of said base panel.

8. An evaporative cooler control device for controlling an evaporative cooling system that includes a pump for conveying water from a reservoir to a pad of air permeable material to wet the pad, and a blower fan for drawing air through the wetted pad and for forcing the air into spaces to be cooled, which control device comprises: a switch housing having a base including means for securing said base to an electrical junction box, said base including first switch positioning means positioning and supporting a manually adjustable, thermally operated switch capable of operating on line voltage and having a bimetallic element for opening and closing said switch to control the operation of an evaporative cooler, and second switch positioning means supporting a pair of manually operated switches to control the operation of a pump and a blower, respectively, that are part of the evaporative cooler, said base including a pair of opposed side panels that extend outwardly from the base, said second switch positioning means extending from one of said side panels and spaced laterally from said first switch positioning means and outwardly from the surface of said base for positioning said pair of second switches, said second switch positioning means including a substantially planar mounting bracket spaced outwardly from and substantially parallel to said base and integral with said one of said side panels, said second switch positioning means having an opening to receive and support said pair of second switches, and cover means removably attached to said base to define an enclosure therewith for housing said pair of second switches.

9. The evaporative cooler control device of claim 8 wherein said base includes integral duct means defined by a cut in said base that defines a tab which can be bent relative to said base to permit the passage through said base of electric conductors connected to said switches.

10. The evaporative cooler control device of claim 8 including supporting means carried by said base for supporting said bimetallic element, said supporting means including a supporting panel extending outwardly from said base and having spaced notches to receive and support said bimetallic element.

11. The evaporative cooler control device of claim 8 wherein said housing includes retention means, a cover having a front panel and means extending outwardly from said front panel for engaging said retention means, said front panel including aperture means to permit said switches to extend partially therethrough to permit manual adjustment and positioning thereof.

12. The housing of claim 11 wherein said retention means includes notches positioned adjacent the intersection of one of said pair of opposed side panels and said base and wherein said engaging means includes inwardly extending flanges spaced from said front panel.

* * * * *